US005857653A

United States Patent [19]

Dujlovich

[11] Patent Number: 5,857,653

[45] Date of Patent: Jan. 12, 1999

[54] SHADE MOUNTING BRACKETS

[75] Inventor: Berislav Dujlovich, Burr Ridge, Ill.

[73] Assignee: National Window Shade Co., Williowbrook, Ill.

[21] Appl. No.: 852,868

[22] Filed: May 7, 1997

[51] Int. Cl.[6] ..... A47H 1/10

[52] U.S. Cl. ..... 248/267; 160/294

[58] Field of Search ..... 248/267, 268, 248/269, 270, 271, 272, 266, 225.21

[56] References Cited

U.S. PATENT DOCUMENTS

| | | | |
|---|---|---|---|
| D. 21,627 | 6/1892 | Meeker | 431/241 |
| 484,028 | 10/1892 | Lawrence | 248/267 |
| 1,101,324 | 6/1914 | Parker | 248/267 |
| 1,120,494 | 12/1914 | Hoenisch | 248/267 |
| 1,425,052 | 8/1922 | Reisa | 248/267 |
| 1,810,099 | 6/1931 | Anderson | 160/294 |
| 1,810,497 | 6/1931 | Perper | 248/267 |
| 1,819,920 | 8/1931 | Reukauf, Jr. | 248/267 |
| 1,867,974 | 7/1932 | Keough | 248/267 |
| 1,928,550 | 9/1933 | Stuber | 248/267 |
| 2,057,253 | 10/1936 | Skinner | 248/267 |
| 2,112,206 | 3/1938 | Clavey | 248/225.21 |
| 2,115,049 | 4/1938 | Suckel | 248/267 |
| 2,392,337 | 1/1946 | Perry | 248/267 |
| 2,548,850 | 4/1951 | Thexton | 248/267 |
| 2,999,664 | 9/1961 | McCullouch | 248/267 |
| 4,226,396 | 10/1980 | Bowers | 248/268 |
| 4,729,418 | 3/1988 | Rude | 160/323.1 |

*Primary Examiner*—Leslie A. Braun
*Assistant Examiner*—Tan Le
*Attorney, Agent, or Firm*—Welsh & Katz, Ltd.

[57] ABSTRACT

Improved shade mounting brackets. The shade mounting brackets comprise a first bracket and a second bracket. The first and second bracket each have a first arm and a second arm, wherein the first arm has a slot and the second arm has at least one aperture constructed and positioned to receive at least one fastener for securing the bracket to a mounting surface. Both brackets also have a body portion, wherein the body portion has at least one aperture constructed and positioned to receive at least one fastener for securing the bracket to the mounting surface. The first bracket slot constructed substantially in the shape of a cross and having a receiver section adapted to accept a round pin of a shade assembly, and a plurality of retention support sections configured to allow the round pin to be rotatably mounted with respect to said first bracket. The second bracket slot has a plurality of retention support sections; the shape of said retention support sections is adapted to accept the flat spear and sized to prevent the flat spear from rotating with respect to the bracket.

11 Claims, 2 Drawing Sheets

SHADE MOUNTING BRACKETS

FIELD OF THE INVENTION

The present invention relates to shade mounting brackets, and more particularly to window shade mounting brackets that duly provide for universal mounting positions of the brackets and provide for enhanced shade stability and retention.

BACKGROUND OF THE INVENTION

Shade mounting brackets of various types are well known in the art. Such apparatus are used for holding a window shade in the desired position to cover a window. These devices are commonly used in a residential or commercial setting. Window shade mounting brackets are generally sold in pairs, each individual bracket in a pair is usually different from the other bracket of the pair, to some extent at least, since one bracket is designed to receive only the flattened spear end which projects from one end of a window shade roller, and the other bracket is designed to receive only the round pin end which projects from the other end of the window shade roller. When the pin end and the spear end are inserted into their corresponding brackets, the window shade is supported by the pair of brackets. Thus, typically each bracket is dissimilar in construction to the other bracket of the pair.

Depending on the desired mounting position of the bracket on or around the window frame, additional hardware or different bracket configurations may be necessary. As a result, most bracket manufacturers must manufacture several different types of brackets. This generally substantially increases manufacturing costs such as tooling, increases inventory volume, and creates potential manufacturing and packaging difficulties. For example, if several separate manufacturing lines are operating, one for each different bracket configuration, and one line is shut down due to mechanical failure, production eventually stops even though the other lines are in good working order. Additionally, extra care must be taken to ensure that one, and only one, bracket of each design is eventually packaged, and this can increase costs due to the need for special packaging machinery and/or higher inspection standards. Accordingly, the more different bracket designs that need to be supplied, the more likely these problems will occur.

The conventional dissimilar-shaped brackets also often pose a problem for the homeowner who wishes to install a pair of brackets. Additional care must be taken, when mounting a set of brackets, to make sure that the bracket design supplied with the shade will provide the desired mounting position, since brackets are not universal. For example, some designs of mounting brackets are capable of being mounted only to a vertical surface, such as a wall or vertical casement surface, while another, quite dissimilar type of bracket must be separately purchased for ceiling or overhead mounting.

The prior art has attempted to provide universal mounting brackets; however, they have some inherent disadvantages. One of the disadvantages is that the brackets are designed so as to require an open-ended slot for the spear end to be properly inserted into the bracket. An open-ended slot is undesirable because the flat spear end of the shade roller assembly is more likely to fall out of the bracket when someone either pulls the shade down or rolls the shade up. This causes a potentially dangerous situation, because the shade assembly can fall out of the bracket and injure the user.

Included in the prior art are brackets that employ an additional part at the interface of the shade roller and the bracket which can be installed in several different ways to provide the required orientation of the engagement feature while maintaining the alignment of the bracket and roller. An additional piece of hardware is disadvantageous because of both additional manufacturing costs and additional difficulty in handling and installation.

The present invention overcomes these and other problems inherent in existing shade mounting brackets. The present invention provides a pair of universal shade mounting brackets for several types of window shades, which eliminates the manufacture and stocking by distributors and stores of a large number of presently used different bracket configurations. A feature of the pair of brackets is that the brackets may be mounted on the inside of the window frame either at the top of the frame or on the sides of the frame, on the wall outside the frame, or on the ceiling. This universality is distinguished from the common slotted bracket which must be maintained with the slot in an upward orientation, so that the rectangular- or square-shaped spear end of the shade roller does not fall out of the slot in the bracket.

OBJECTS OF THE INVENTION

The principal object of the present invention is to provide a pair of shade brackets that can be universally mounted on the inside of the window frame either at the top of the frame or on the sides of the frame, on the wall outside the frame, or on the ceiling.

Another object of the present invention is to provide a pair of shade brackets, each of which is a one piece construction.

A further object of the present invention is to provide a pair of shade brackets that will provide for enhanced retention of the shade once the shade is received by the brackets.

A further object of the present invention is to provide a pair of shade brackets which is simple in design and inexpensive to construct, and is durable and rugged in structure.

A further object of the present invention is to provide a pair of shade brackets that is easy to secure to a mounting surface and provides for easy installation of the shade roller.

A further object of the present invention is to provide a pair of shade brackets having an attractive appearance.

Still further objects and advantages will become apparent from a consideration of the ensuing description and drawings of the invention.

SUMMARY OF THE INVENTION

These and other objects are achieved by a pair of shade mounting brackets of the present invention. In one form of the invention, a pair of shade mounting brackets is provided, that, when attached to a mounting surface by at least one fastener, is capable of supporting both ends of a shade assembly, wherein the shade assembly has a round pin at one end and a flat spear at a second end. The pair of brackets comprises a first bracket and a second bracket. The first and second bracket each have a first arm and a second arm, wherein the first arm has a slot and the second arm has at least one aperture constructed and positioned to receive at least one fastener for securing the bracket to the mounting surface. Both brackets also have a body portion, wherein the body portion has at least one aperture constructed and positioned to receive at least one fastener for securing the bracket to the mounting surface.

The first bracket slot is constructed substantially in the shape of a cross, and has a receiver section adapted to accept the round pin end of the shade assembly and a plurality of retention support sections configured to allow the round pin to be rotatably mounted with respect to said first bracket. The second bracket slot has a plurality of retention support sections; the shape of said retention support sections is adapted to accept the flat spear and sized to prevent the flat spear from rotating with respect to the bracket.

DETAILED DESCRIPTION OF THE PREFERRED EMBODIMENTS

Figure 1:
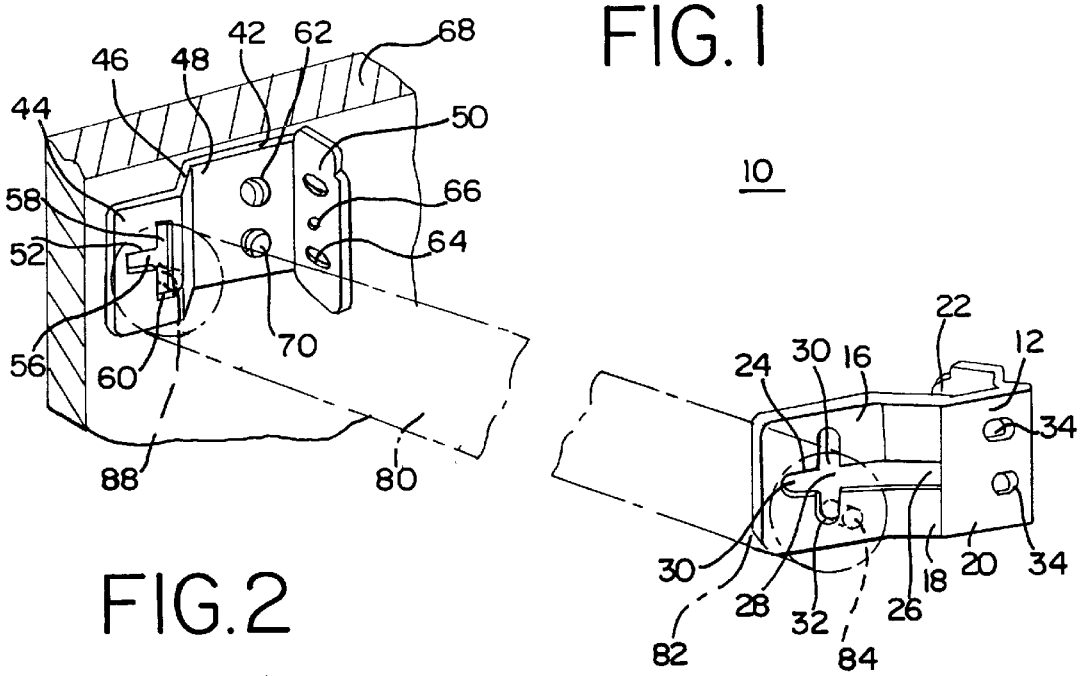
FIG. 1 is a perspective view of one embodiment of the pair of universal shade mounting brackets of the present invention, shown attached to a vertical mounting surface.

FIG. 1 is a perspective view of one embodiment of the pair of universal shade mounting brackets 10 constructed in accordance with the present invention, shown attached to a mounting surface. In FIG. 1, the pair of mounting brackets 10 comprises a first bracket 12 and a second bracket 42. The first bracket 12 has a first arm 16. A spacer portion 18 may also be included and disposed between the first arm 16 and a body portion 20. The first bracket 12 also has a second arm 22 that is attached substantially perpendicular to the body portion 20. The first arm 16, body portion 20 and second arm 22 are joined and form generally an L-shaped structure.

Disposed in the first arm 16 is a cross-shaped slot 24 that has a receiver section 26 that communicates with slot junction 28. The receiver section 26 is adapted to receive a round pin 84 of a roller shade assembly 80. If the spacer portion 18 is included in the bracket 12 configuration, the receiver section 26 may extend substantially along the length of the spacer portion 18 to facilitate installation of the round pin 84. The slot junction 28 joins and communicates with a plurality of slot throats 30 that communicate with a plurality of retention support sections 32. A preferred embodiment would contain three slot throats 30 and three retention support sections 32, although other embodiments could contain fewer or more slot throats 30 and retention support sections 32. The retention support sections 32 may be constructed to have a square or a round shape depending on the application. However, in a preferred embodiment, the retention support sections 32 should be adapted to allow the round pin 84 to be rotatably mounted with respect to the first bracket 12.

Figure 3:
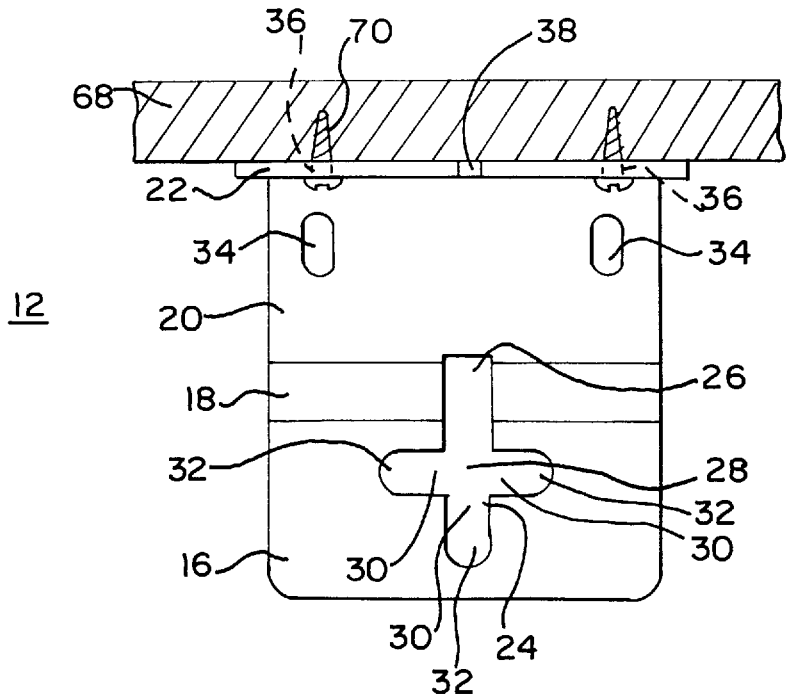
FIG. 3 is view taken along the line 3—3 of FIG. 2.

As best seen in FIG. 3, disposed in the body portion 20 are a plurality of apertures 34 positioned and constructed to receive fasteners 70, such as screws, nails, rivets, or some other fastening devices capable of securely mounting the bracket 12 to a mounting surface 68. Apertures 34 would generally be used when the bracket 12 is mounted to a substantially vertical mounting surface as shown in FIG. 1.

Figure 2:
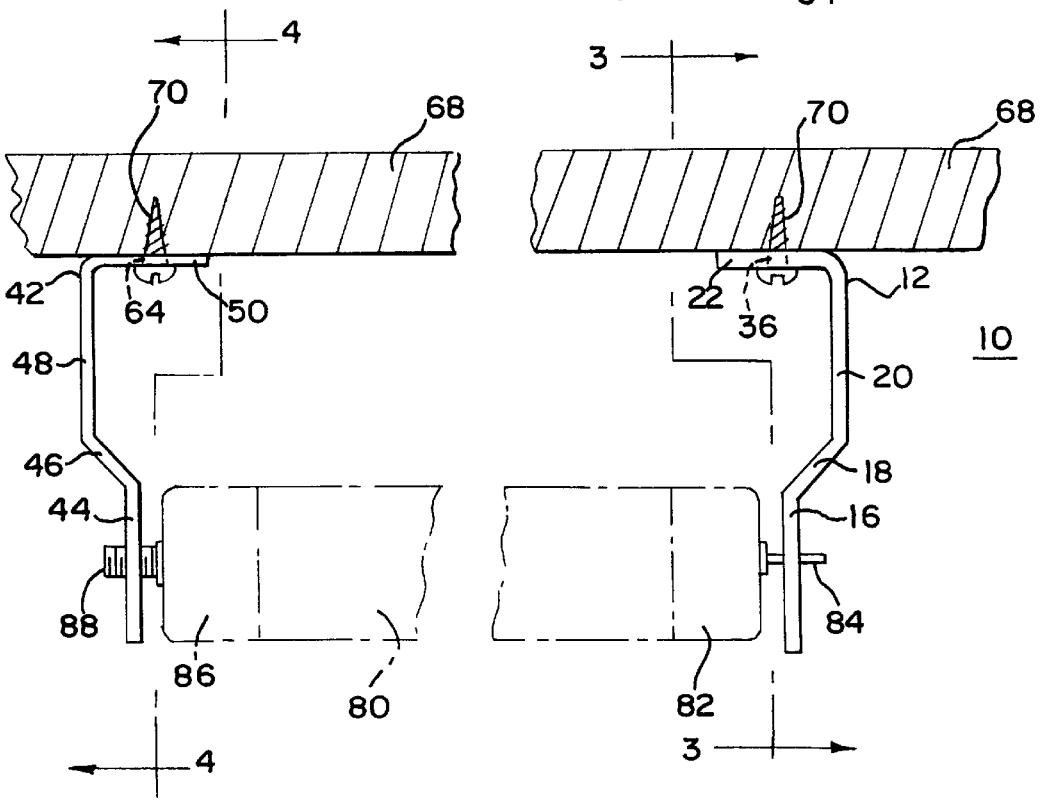
FIG. 2 is a an edge view of the pair of universal shade mounting brackets of FIG. 1, shown attached to a horizontal mounting surface.

As best seen in FIG. 2 and FIG. 3, disposed in the second arm 22 are a plurality of apertures 36 and 38 positioned and constructed to receive fasteners 70, such as screws, nails, rivets, or some other fastening devices capable of securely mounting the bracket 12 to a mounting surface 68. Apertures 36 and 38 would generally be used when the bracket 12 is mounted to a substantially horizontal mounting surface as shown in FIGS. 2 and 3.

Turning back to FIG. 1, the second bracket 42 has a first arm 44. A spacer portion 46 may also be included and disposed between the first arm 44 and a body portion 48. The second bracket 42 also has a second arm 50 that is attached substantially perpendicular to the body portion 48. The first arm 44, body portion 48 and second arm 50 are joined and form generally an L-shaped structure.

Disposed in the first arm 44 is a generally T-shaped slot 52 that has a slot junction 56. The slot junction 56 joins a plurality of slot throats 58 that adjoin a plurality of retention support sections 60. A preferred embodiment would contain three slot throats 58 and three retention support sections 60, although other embodiments could contain fewer or more slot throats 58 and retention support sections 60. In a preferred embodiment, the retention support sections 60 should be adapted and sized to accept the flat spear 88 of the roller shade assembly 80 such that the flat spear 88 cannot rotate with respect to the second bracket 42.

Figure 4:
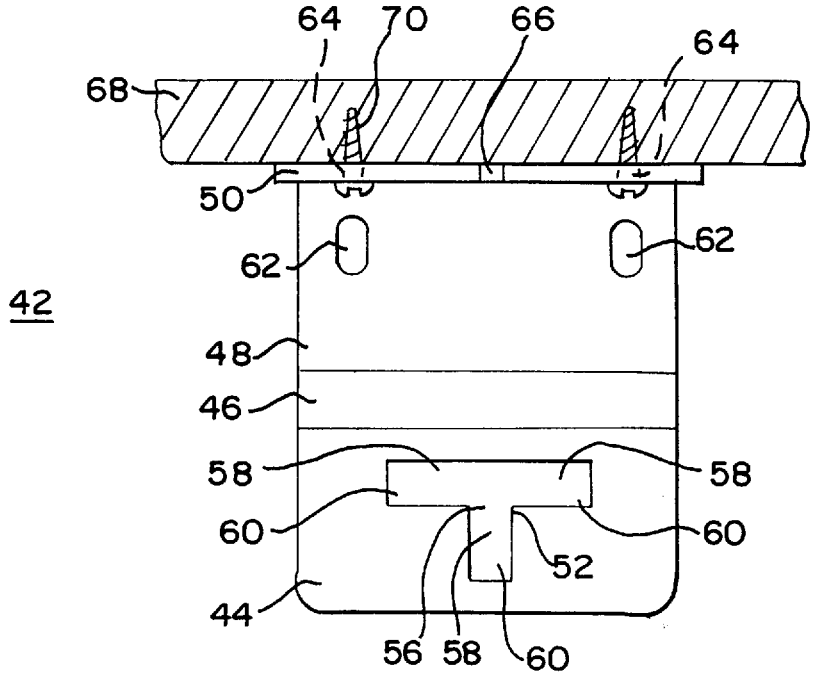
FIG. 4 is a view taken along the line 4—4 of FIG. 2.

As best seen in FIG. 4, disposed in the body portion 48 are a plurality of apertures 62 positioned and constructed to receive fasteners 70, such as screws, nails, rivets, or some other fastening devices capable of securely mounting the bracket 42 to a mounting surface 68. Apertures 62 would generally be used when the bracket 42 is mounted to a substantially vertical mounting surface 68 as shown in FIG. 1.

As best seen in FIG. 2 and FIG. 4, disposed in the second arm 50 are a plurality of apertures 64 and 66 positioned and constructed to receive fasteners 70, such as screws, nails, rivets, or some other fastening devices capable of securely mounting the bracket 42 to a mounting surface 68. Apertures 64 and 66 would generally be used when the bracket 42 is mounted to a substantially horizontal mounting surface 68 as shown in FIGS. 2 and 4.

It is also noted that the first bracket 12 and the second bracket 42 are each a one-piece structure and can be easily and efficiently made by conventional, inexpensive bending and shaping manufacturing processes followed or preceded by a punching operation to form the openings. The first bracket 12 and the second bracket 42 are preferably constructed of 0.6 in. cold rolled steel with barrel zinc and yellow chromate with a lacquered finish. The brackets 12 and 42 can also be constructed of various other materials capable of maintaining the required shape and rigidity necessary to support a window shade.

Specific embodiments of novel methods and apparatus for construction of shade mounting brackets according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

I claim:

1. A pair of shade mounting brackets for a shade assembly having a round pin end at one end and a flat spear at a second end, that when attached to a mounting surface by at least one fastener secured in each of the brackets is capable of supporting both ends of a shade assembly, said brackets comprising:

a first bracket;

a second bracket;

the first and second bracket each having a first arm and a second arm, wherein the first arm has a slot and the second arm has at least one aperture constructed and positioned to receive at least one fastener for securing the bracket to the mounting surface, a body portion, wherein the body portion has at least one aperture constructed and positioned to receive at least one fastener for securing the bracket to the mounting surface, and a spacer portion, wherein the spacer portion is disposed between the body portion and the first arm such that the first arm is offset from the body portion;

said first bracket slot constructed substantially in the shape of a cross and having a receiver section adapted to accept the round pin end of the shade assembly, and a plurality of retention support sections configured to allow the round pin to be rotatably mounted with respect to said first bracket;

the first bracket slot is disposed in the first arm so that the retention support sections are closed-ended and said first bracket slot receiver section is long enough to extend to and also be disposed on the spacer portion;

said second bracket slot having a plurality of retention support sections, the shape of said retention support sections adapted to accept the flat spear and sized to prevent the flat spear from rotating with respect to said bracket; and the second bracket slot is disposed in the first arm so that the retention support sections are closed-ended.

2. The shade mounting brackets of claim 1 wherein the retention support sections of the first bracket are substantially round in shape.

3. The shade mounting brackets of claim 2 wherein the first bracket and the second bracket are constructed of a metal.

4. The shade mounting brackets of claim 2 wherein the first bracket and the second bracket are constructed of a plastic.

5. The shade mounting brackets of claim 2 wherein the first bracket and the second bracket are constructed of a fibrous material.

6. A first shade mounting bracket for a shade assembly requiring a pair of mounting brackets, the assembly having a round pin at one end and a flat spear at a second end, that can be attached to a mounting surface by at least one fastener secured in each bracket, said bracket comprising:

a first arm and a second arm, wherein the first arm has a slot and the second arm has at least one aperture constructed and positioned to receive at least one fastener for securing the bracket to the mounting surface, a body portion, wherein the body portion has at least one aperture constructed and positioned to receive at least one fastener for securing the bracket to the mounting surface, and a spacer portion, wherein the spacer portion is disposed between the body portion and the first arm such that the first arm is offset from the body portion;

said first bracket slot constructed substantially in the shape of a cross and having a receiver section adapted to accept the round pin end of the shade assembly, and a plurality of retention support sections configured to allow the round pin to be rotatably mounted with respect to said first bracket; and the first bracket slot is disposed in the first arm so that the retention support sections are closed-ended and said first bracket slot receiver section is long enough to extend to and also be disposed on the spacer portion.

7. The shade mounting bracket of claim 6 further including a second shade mounting bracket, wherein the second shade mounting bracket has a first arm and a second arm, wherein the first arm has a slot and the second arm has at least one aperture constructed and positioned to receive at least one fastener for securing the bracket to the mounting surface, a body portion, wherein the body portion has at least one aperture constructed and positioned to receive at least one fastener for securing the bracket to the mounting surface, and a spacer portion, wherein the spacer portion is disposed between the body portion and the first arm such that the first arm is offset from the body portion;

said second bracket slot having a plurality of retention support sections, the shape of said retention support sections adapted to accept the flat spear and sized to prevent the flat spear from rotating with respect to said bracket; and the second bracket slot is disposed in the first arm so that the retention support sections are closed-ended.

8. The shade mounting brackets of claim 7 wherein the retention support sections of the first bracket are substantially round in shape.

9. The shade mounting brackets of claim 8 wherein the first bracket and the second bracket are constructed of a metal.

10. The shade mounting brackets of claim 8 wherein the first bracket and the second bracket are constructed of a plastic.

11. The shade mounting brackets of claim 8 wherein the first bracket and the second bracket are constructed of a fibrous material.

* * * * *